US011407084B2

(12) United States Patent
Tuckner et al.

(10) Patent No.: US 11,407,084 B2
(45) Date of Patent: Aug. 9, 2022

(54) GRINDER PARTICULATE CONTROL ASSEMBLY

(71) Applicants: John Tuckner, Maplewood, MN (US); Milo Horak, Bayport, MN (US)

(72) Inventors: John Tuckner, Maplewood, MN (US); Milo Horak, Bayport, MN (US)

( * ) Notice: Subject to any disclaimer, the term of this patent is extended or adjusted under 35 U.S.C. 154(b) by 706 days.

(21) Appl. No.: 16/357,268

(22) Filed: Mar. 18, 2019

(65) Prior Publication Data

US 2019/0283210 A1 Sep. 19, 2019

Related U.S. Application Data

(60) Provisional application No. 62/644,075, filed on Mar. 16, 2018.

(51) Int. Cl.
*B24B 55/10* (2006.01)
*B24B 55/05* (2006.01)

(52) U.S. Cl.
CPC ..... *B24B 55/102* (2013.01); *B24B 55/052* (2013.01)

(58) Field of Classification Search
CPC ..... B24B 55/102; B24B 55/052; B24B 55/10; B24B 55/105; B24B 55/05; B24B 55/04; B23Q 9/0028; B23C 3/126; B23C 1/12; B23C 2220/40
USPC .... 451/451, 455, 456, 344, 548; 125/12, 20; 30/382; 144/134.1, 135
See application file for complete search history.

(56) References Cited

U.S. PATENT DOCUMENTS 2,635,655 A * 4/1953 Linstead ..... B23Q 9/0028 144/135
2,699,805 A * 1/1955 Richter ..... B23Q 9/0028 30/481
3,212,541 A * 10/1965 Burrows ..... B23C 3/126 144/134.1
3,585,980 A * 6/1971 Mellor ..... B24B 55/102 125/13.01
3,893,372 A * 7/1975 Strakeljahn ..... B24B 23/08 144/136.95
4,319,433 A * 3/1982 Nolen ..... B23D 45/16 30/295
4,674,548 A * 6/1987 Mills ..... B23Q 11/0046 144/154.5
4,977,938 A * 12/1990 Greeson ..... B27G 5/04 83/745
4,988,245 A * 1/1991 Fukuda ..... B23C 3/126 144/136.95
5,028,179 A * 7/1991 Grasset ..... B23C 3/126 409/138

(Continued)

FOREIGN PATENT DOCUMENTS

JP 11277315 A * 10/1999 ..... B23C 3/12
WO WO-2006122532 A1 * 11/2006 ..... B23C 1/20

OTHER PUBLICATIONS

"Chamfering by means of a portable grinder", 3 screen captures, uploaded on Nov. 14, 2016 by user RAKO. Retrieved from internet: <https://www.youtube.com/watch?v=xSbnOhUIMpg> (Year: 2016).*

*Primary Examiner* — Joel D Crandall
(74) *Attorney, Agent, or Firm* — Skaar Ulbrich Macari P.A.

(57) ABSTRACT

A grinder particulate control assembly for collecting particulate generated while grinding an outside corner surface. The grinder particulate control assembly having an adjustable bonnet capable of being used with grinders and grinding disks of various sizes.

19 Claims, 10 Drawing Sheets

(56) References Cited

U.S. PATENT DOCUMENTS

| | | | | | |
|---|---|---|---|---|---|
| D324,632 | S * | 3/1992 | Nose | B27G 5/04 | D8/61 |
| 5,522,684 | A * | 6/1996 | Heck | B23C 3/12 | 409/138 |
| D383,366 | S * | 9/1997 | Heck | B24B 23/08 | D8/67 |
| 6,318,352 | B1 * | 11/2001 | Gnazzo | B23D 59/006 | 125/12 |
| 6,450,741 | B1 * | 9/2002 | Cannelli, Jr. | B23C 3/12 | 409/229 |
| 6,702,659 | B1 * | 3/2004 | Moncrieff | B26B 29/06 | 451/438 |
| 8,740,521 | B2 * | 6/2014 | Jeon | B23C 3/12 | 408/202 |
| 8,777,698 | B2 * | 7/2014 | O'Shannessy | B25H 1/0021 | 451/344 |
| 8,801,346 | B2 * | 8/2014 | Su | B26D 3/02 | 409/138 |
| 2004/0168681 | A1 * | 9/2004 | Kalb | B24B 41/04 | 125/10 |
| 2011/0092141 | A1 * | 4/2011 | McCutchen | B24B 55/05 | 451/451 |

* cited by examiner

GRINDER PARTICULATE CONTROL ASSEMBLY

PRIORITY

This patent application claims priority to and the benefit of U.S. Provisional Patent Application No. 62/644,075, filed Mar. 16, 2018, which is incorporated fully herein by reference.

FIELD

The present invention relates generally to particulate control assemblies and more particularly, to dust shrouds or guards for use on grinders capable of grinding outside corners.

BACKGROUND

Power tools capable of grinding finishes such as cement, brick and the like have been around for years. These power tools are generally operated by electric motors that spin or rotate a grinding wheel, disk or medium mounted on a rotating shaft. The grinding wheel typically rotates at a considerable speed grinding the finish into generally fine particles.

The ground particles are often ejected from the grinding wheel or disk into the environment. The ejected particles pose a number of risks. Typical grinding wheels rotate at a speed of over 1000 rotations per minute. At these speeds the particulate is turned into a dangerous projectile that can become embedded an operator's or bystander's skin or eyes. Typical grinders are also capable of grinding the finish into a fine dust particle that poses a health risk to operators and bystanders. The fine dust can be inhaled and enter an individual's lungs where it can cause immediate and latent respiratory and cardiopulmonary health effects. For example, it can cause premature death in people with heart and lung disease, non-fatal heart attacks, irregular heartbeats, aggravated asthma and decreased lung function.

To limit or control the particulate or dust shrouds or guards have been developed that fit over the grinding wheels of grinders. These shrouds or guards typically enclose at least a portion of the grinding wheel or disk. Since these shrouds enclose the grinding wheel they are able to direct or funnel at least a portion of the particulates or dust into a collection bag or container.

These grinder shrouds have been beneficial for grinders used on flat surfaces such as walls, floors and ceilings. Since these typical grinders cover or shroud a majority of the grinding wheel they have not been able to be used on corner grinders. As a result, operators of corner grinders are still exposed to large and fine finish particulates and dust.

Additionally, angle grinders are often used to cut or chamfer an angle into a 90 degree outside corner. This is done for a number of reasons, including to increase the visual appearance of the corner, to reduce the possibility of injury caused by a sharp corner, and to eliminate defects created when the corner was formed. Current angle grinders, however, only allow for adjusting the size of a chamfer by adjusting a setting on the grinder. As a result, construction workers often must own multiple corner grinders in order to complete a job.

In all of the grinder devices available or described a need has remained for a corner grinder shroud or guard that contains and collects out-side corner ground particulate material, is connectable to a variety of different grinders, and can be adjusted to enable cutting or grinding chamfered edges of various sizes. It is thus apparent that a device and method having these advantages would be very desirable.

SUMMARY

The present invention is related to an adjustable grinder particulate control assembly that is removably attachable or connectable to a variety of different grinders having a grinding disk connected to a motor by a spindle. The adjustable particulate control assembly includes a guard, shield, or bonnet that is able to partially enclose a grinding disk. The bonnet acts to capture particulate material or dust created during the grinding process. The bonnet includes a notched side or end wall having a size and shape capable of receiving a corner to be ground or chamfered.

In another embodiment of the present invention, the particulate control assembly includes an angle guide having a bottom wall that nests inside of and releasably connects to the bonnet. The bottom wall of the angle guide acts to partially enclose the interior of the bonnet to provide additional protection against diffusing particulate material. The angle guide has one or more end walls that extend from the bottom wall. The end walls and the bottom wall include a corner opening that can be aligned with the notches of the bonnet when the angle guide is nested to permit an operator to apply the partially exposed grinding disk to an outside corner to be chamfered.

The angle guide or the bonnet may include fasteners that permit adjustment of the angle guide with respect to the bonnet. The adjustability of the angle guide with respect to the bonnet permits a user to adjust a distance between an apex of the corner openings and the grinding wheel. Adjustment of this distance permits adjustment of the size of chamfer.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1A:
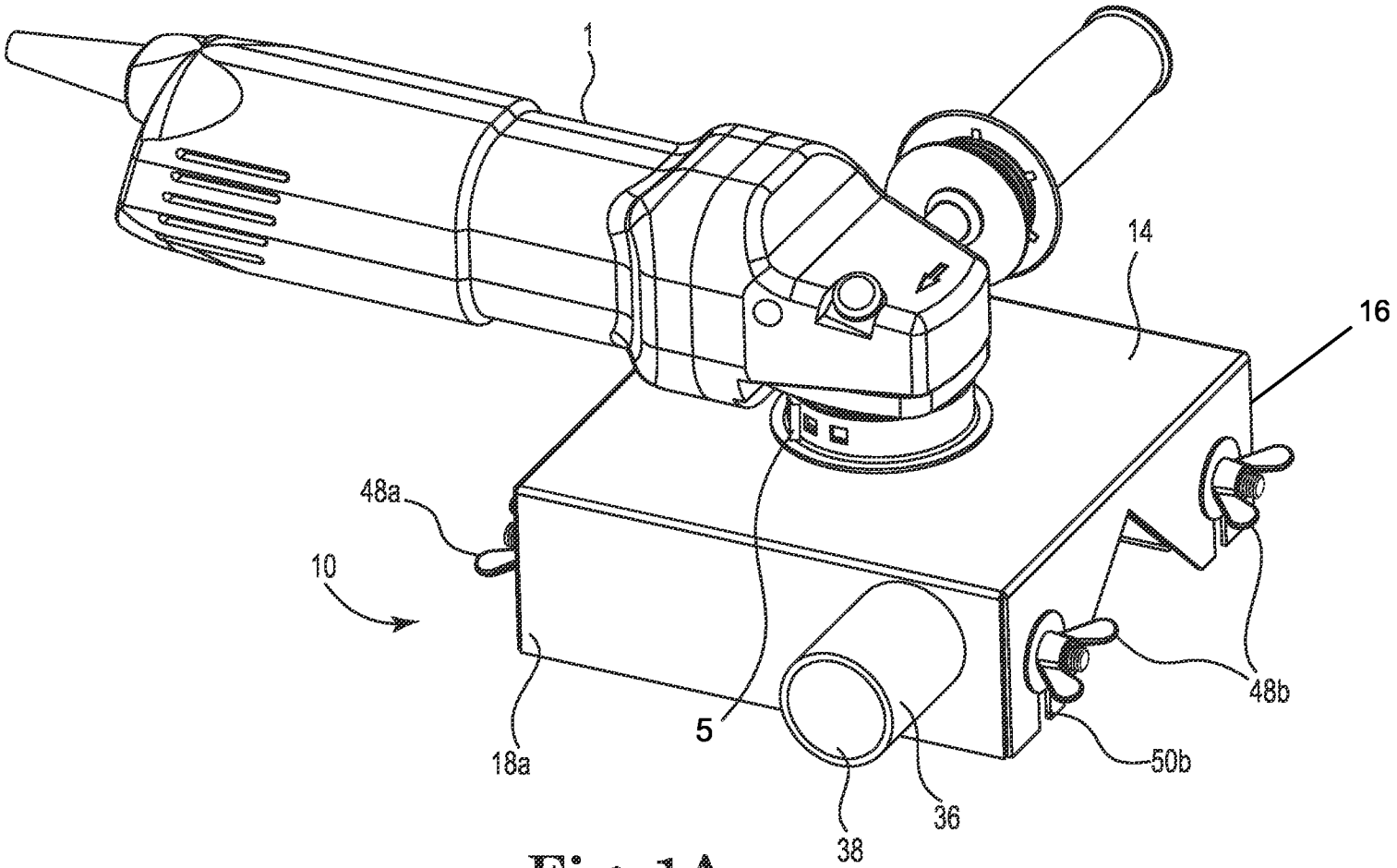
FIG. 1A is a perspective view of a corner grinder shroud assembly coupled to a corner grinder according to an example embodiment.
Figure 1B:
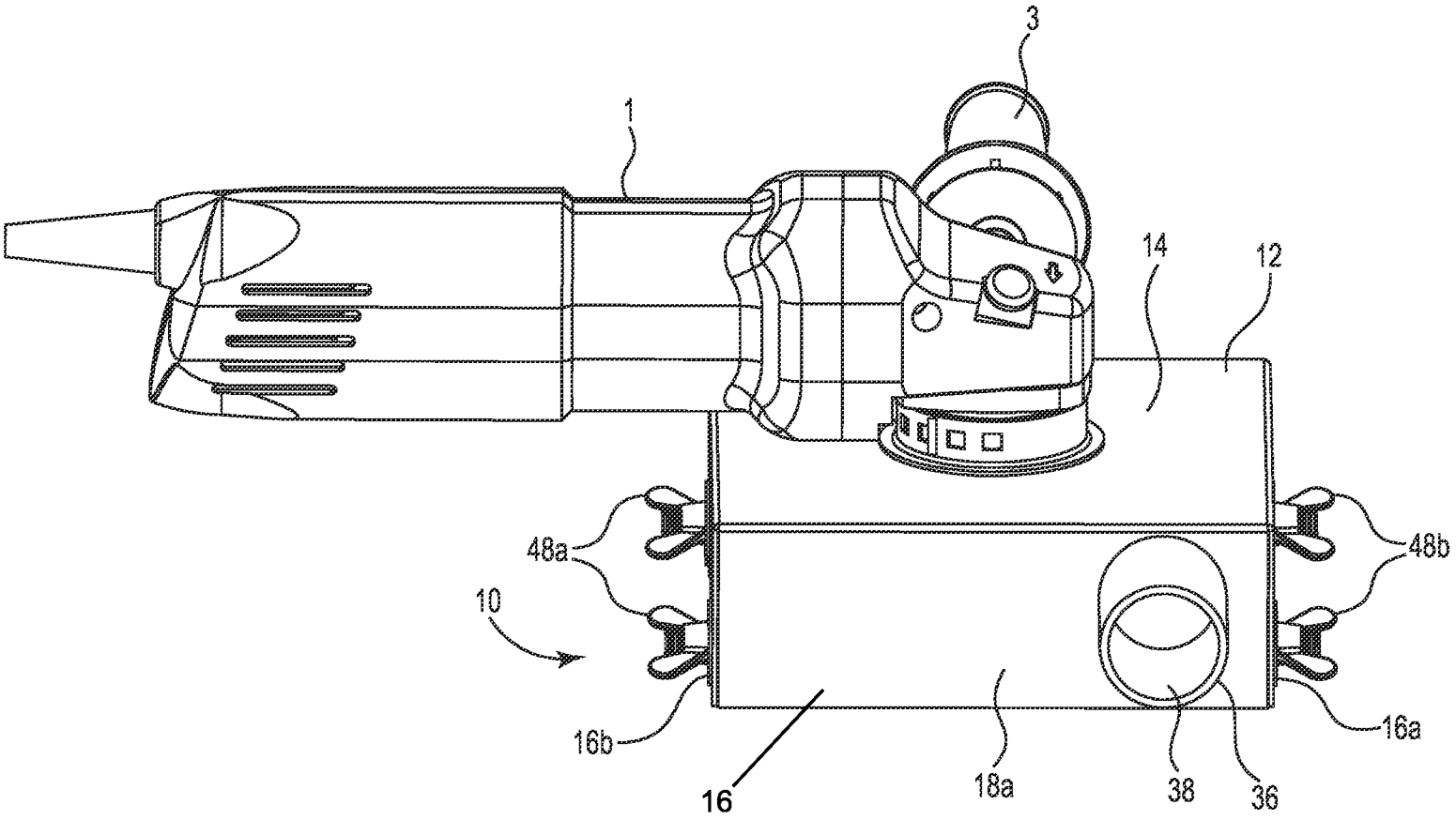
FIG. 1B is a perspective view of a corner grinder shroud assembly coupled to a corner grinder according to an example embodiment.
Figure 1C:
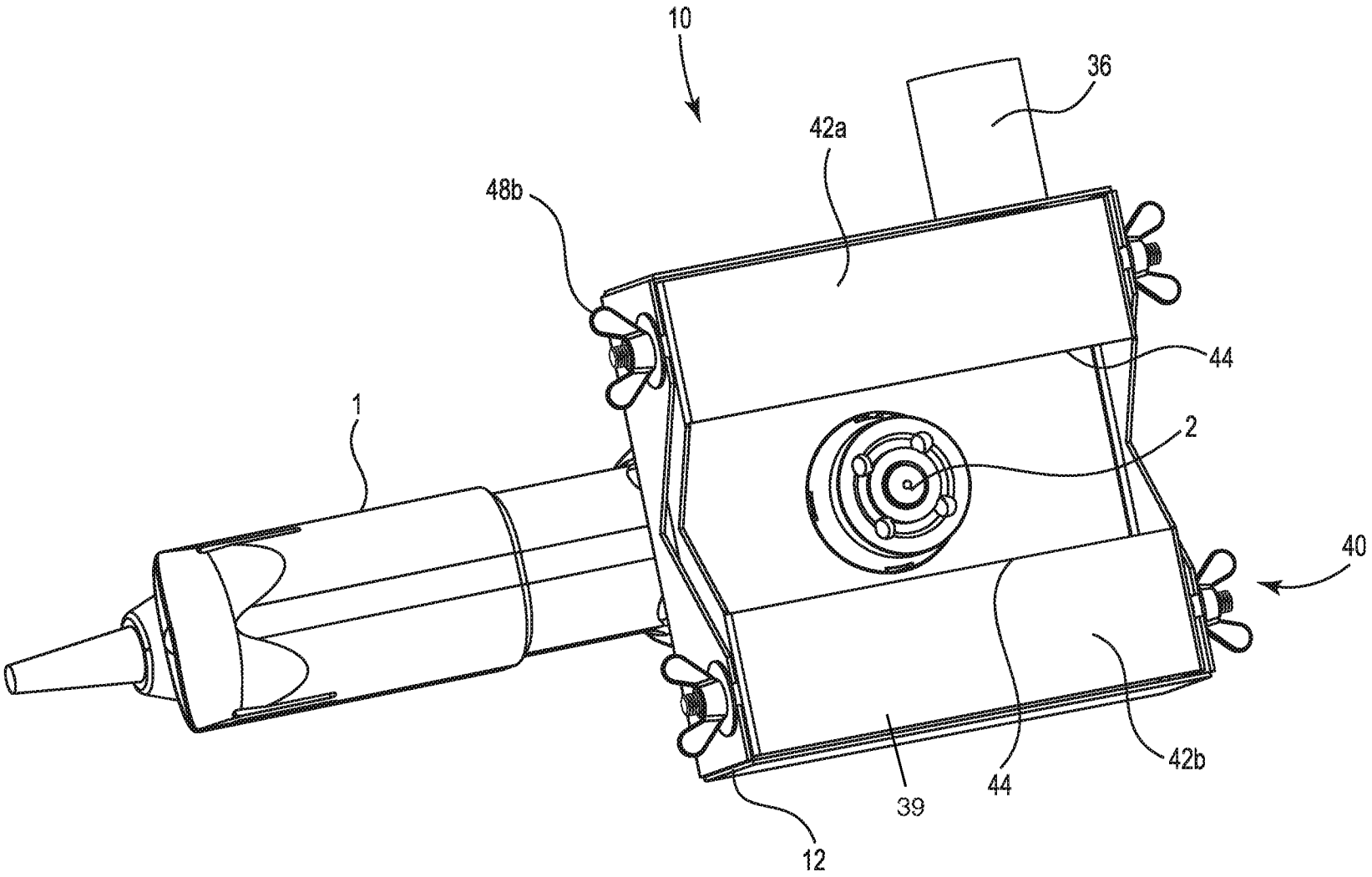
FIG. 1C is a bottom perspective view of a corner grinder shroud assembly coupled to a corner grinder according to an example embodiment.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Dimensions and relative proportions of components are merely example embodiments and can be varied unless specifically limited in a given claim. Thus, the dimensions can be varied without departing from the scope of the invention.

Referring to FIGS. 1A-6, the present invention of an adjustable grinder particulate control assembly 10 is removably attachable or connectable to a grinder 1 having a spindle 2 that is operatively coupled to a motor and extends through a portion of the grinder particulate control assembly 10. The grinder 1 may also include a handle 3 used by an operator to control the grinder 1. The grinder 1 may also include a lock nut used to secure a grinding disk 4 or wheel to the spindle 2 within the grinder particulate control assembly 10.

The grinder particulate control assembly 10 includes a shroud, upper hood, bonnet, or guard 12 that has a top wall or upper surface 14 and a downwardly extending perimeter wall 16, that includes end walls 16*a* and 16*b*. The perimeter wall 16 may also include straight or curved side walls 18*a* and 18*b* that extend between the upper surface 14 and the end walls 16*a* and 16*b*. The hood or bonnet 12 and the perimeter wall 16 create a containment or interior 17 for housing the grinding wheel or disk 4 and the particulates or dust. Although the bonnet 12 is illustrated in a generally square configuration it should be appreciated that the upper surface 14, end walls 16*a* and 16*b*, and/or side walls 18*a* and 18*b* may be generally curved or a mixture of straight, flat, or curved. The bonnet 12 may have any shape and the form illustrated herein should not be considered limiting.

In one example embodiment of the invention, a portion of the perimeter wall 16, such as end walls 16*a* and 16*b* includes at least one pair of notches 20*a* and 20*b* extending from a free edge 21 of the end walls 16*a* and 16*b* toward the upper surface 14. The notches 20*a* and 20*b* are sized and shaped to receive a corner surface to be chamfered during the grinding procedure or operation of the grinder 1. The notches 20*a* and 20*b* of the present invention are illustrated as having an obtuse angle of 90 degrees but a bonnet 12 with various angled notches are contemplated herein and are within the spirit and scope of the invention.

Figure 1D:
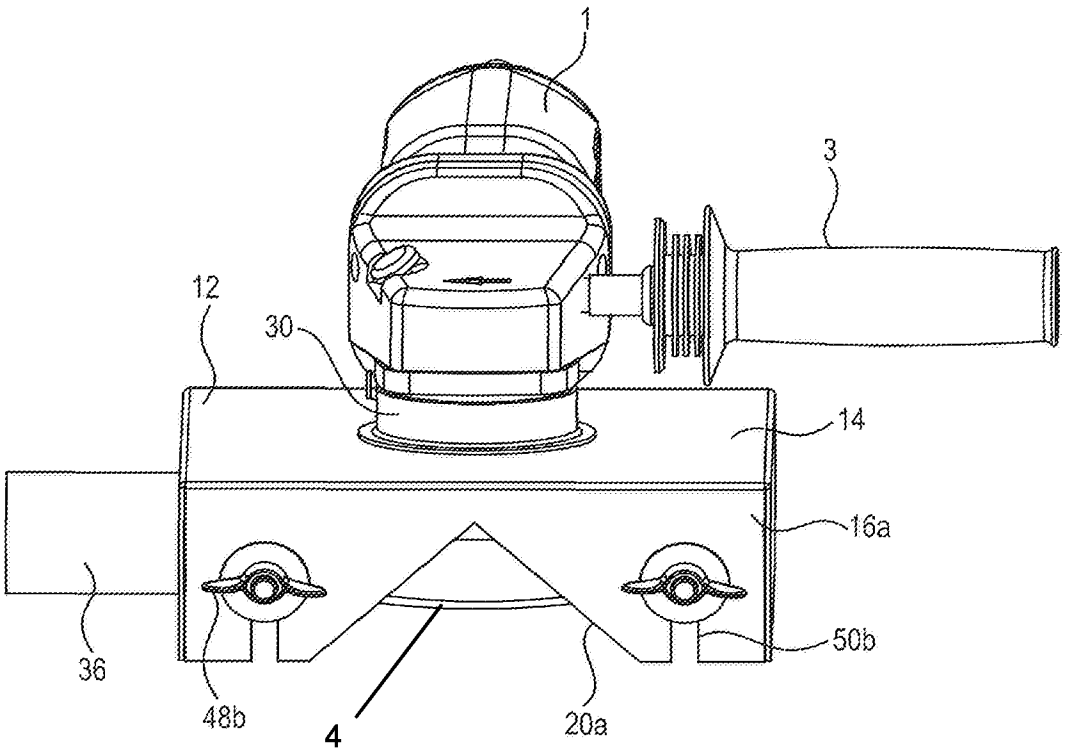
FIG. 1D is a bottom perspective view of a corner grinder shroud assembly coupled to a corner grinder according to an example embodiment.

As illustrated in FIG. 1D, the notches 20*a* and 20*b* have a wider opening and form an apex generally proximate to the upper surface 14. The distance between the apex of the notches 20*a* and 20*b* and the grinding disk 4 (illustrated as letter A) defines the size of the chamfered corner. The closer the grinding disk 4 is to the apex of the notches 20*a* and 20*b* the smaller the size of the chamfer. Likewise, the further the grinding disk 4 is from the apex of the notches 20*a* and 20 the larger the size of the chamfer.

Figure 2A:
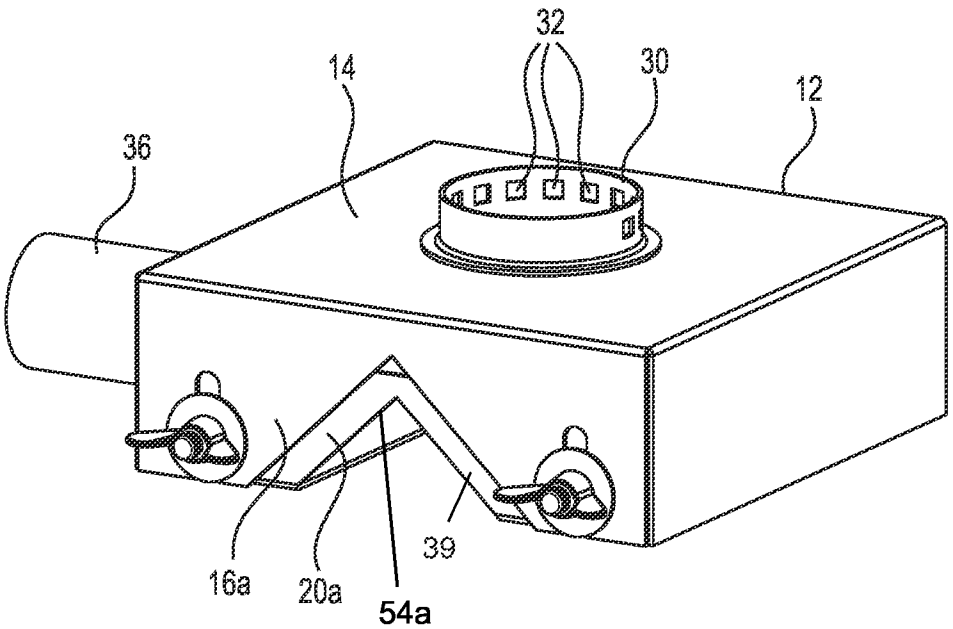
FIG. 2A is a perspective view of the corner grinder shroud assembly according to an example embodiment of the invention.
Figure 2B:
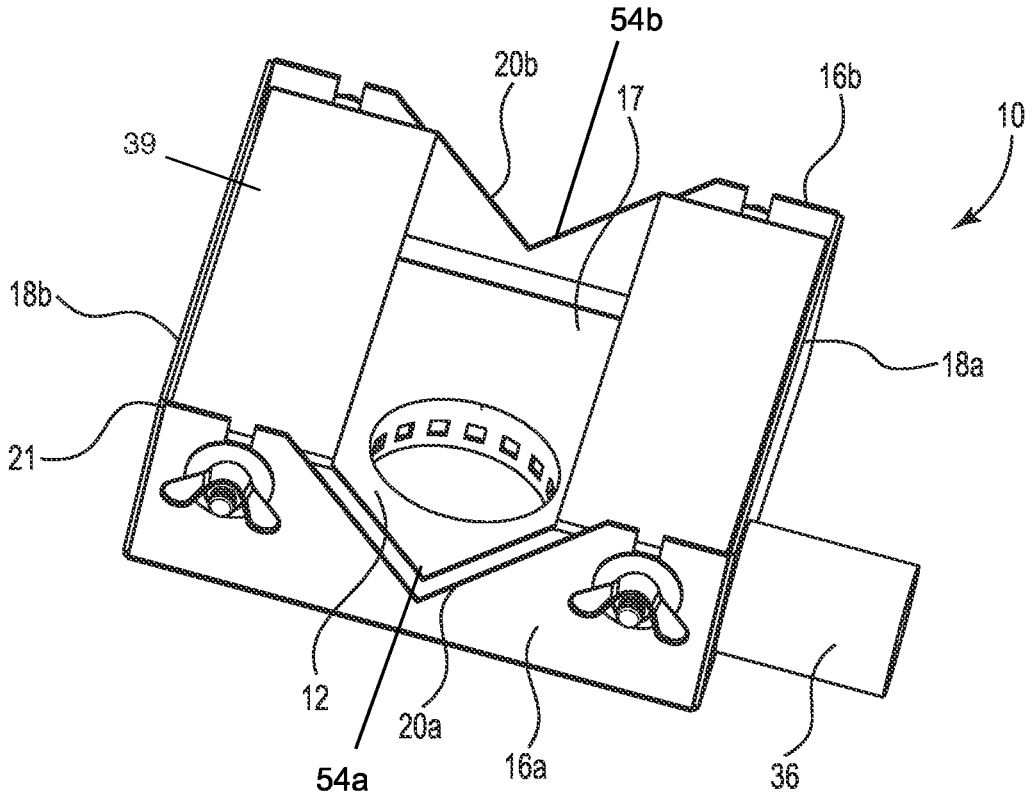
FIG. 2B is a bottom perspective view of the corner grinder shroud assembly according to an example embodiment of the invention.
Figure 3:
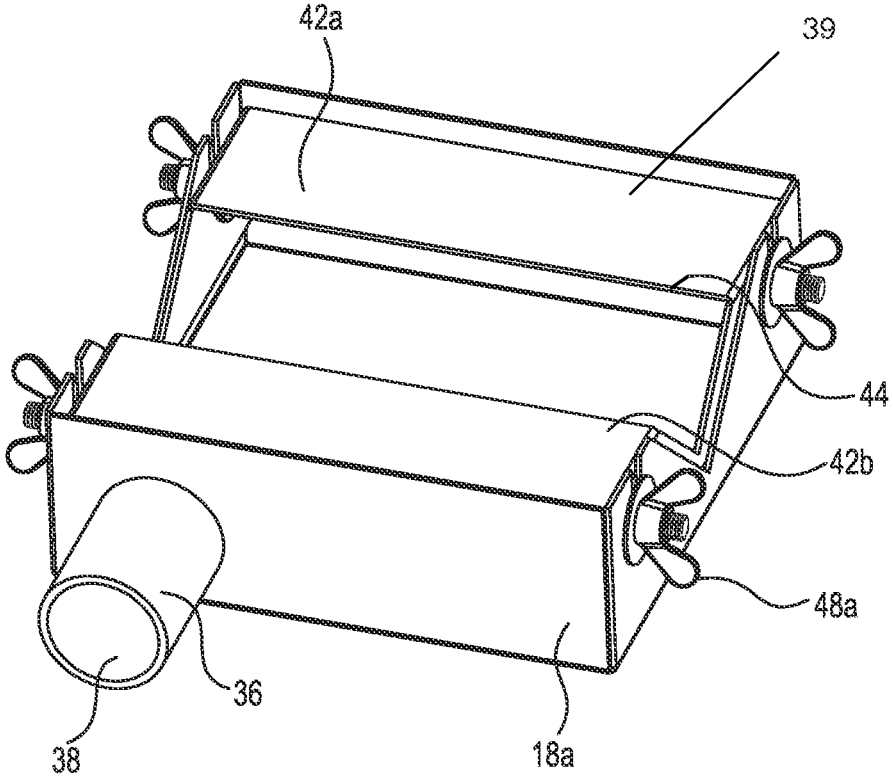
FIG. 3 is a bottom perspective view of the corner grinder shroud assembly according to an example embodiment of the invention.

As particularly illustrated in FIG. 2A, the top wall or upper surface 14 of the bonnet 12 may include a collar 30 attached to extending away therefrom for releasably connecting to a body or portion of a grinder 1. In one example embodiment, the collar 30 includes one or more slots or holes 32 extending therein or therethrough that are capable of receiving a latch or catch 5 attached to the body of the grinder 1. The latch 5 releasably secures the bonnet 12 to the grinder body 1. The bonnet 12 also includes opening extending through the collar 30 for receiving a shaft or spindle 2 of the grinder 1. The shaft or spindle 2 of the grinder 1 is positioned in the interior 17 of the bonnet 12 when coupled to the grinder 1. Other securement mechanisms may also be employed to secure the bonnet 12 to the grinder body 1. For instance, screws, chucks, clips, pressure fit, twist or screw on configurations are also contemplated herein.

In order to control and direct the particulate material away from an operator during use, the bonnet 12 includes a duct, channel, or discharge port 36 that is in fluid communication with the interior 17 of the bonnet 12. The discharge port 36 extends from a portion of the perimeter wall 16, such as one of the end walls 16*a*-16*b* or side walls 18*a*-18*b* or from the upper surface 14 of the bonnet 12. The discharge port 36 has an open end 38 that can be coupled to a conduit, bag or a vacuum assembly for collecting the particulate material passing through the discharge port 36.

In one example embodiment of the invention, the grinder particulate control assembly 10 includes an angle guide 39 that acts to partially enclose the interior 17 and is capable of adjusting the size of the chamfer. The angle guide 39 includes a bottom wall 40 that partially encloses the interior 17 of the bonnet 12. The bottom wall 40 limits the diffusion of the particulate material or dust. The bottom wall 40 has a first bottom portion 42*a* spaced apart from a second bottom portion 42*b*. The first bottom portion 42*a* and the second bottom portion 42*b* define a corner opening 44 for receiving an outside-corner to be ground or worked.

The angle guide 39 also includes end walls 46*a* and 46*b* attached to and extending upwardly from the bottom wall 40. The end walls 46*a* and 46*b* each include at least one adjustable corner notch 54*a* and 54*b*, respectively. Each of the adjustable corner notches 54*a* and 54*b* has a size and shape adapted to receive the outside corner being worked or ground.

Each of the adjustable corner notches 54*a* and 54*b* has a wider opening and an apex that is generally positionable proximate to the upper surface 14 of bonnet 12 when it's nested therein.

In one example embodiment of the invention, the notches 20*a* and 20*b* of the bonnet 12 and the adjustable corner notches 54*a* and 54*b* are similarly sized and shaped. In one example embodiment, each of the notches 20*a*, 20*b*, 54*a* and 54*b* have an angle of approximately 90 degrees. The angle created by the notches of the 20*a*, 20*b*, 54*a* and 54*b* with respect to the grinding disk 4 is approximately 45 degrees. It is contemplated herein that various angles may be employed and designed to permit chamfered outside-corner angles of various sizes.

The angle guide 39 can be adjustably coupled to a portion of the bonnet 12 to enable the grinder particulate control assembly 10 to accommodate grinders 1 and grinding wheels 4 or disks of various sizes. The adjustablility also enables the distance between an apex of a notch 20*a*, 20*b*, 54*a* and 54*b* and the grinding disk 4 to be adjusted, which permits a user to select a size of the chamfer applied to the outside-corner.

Figure 4:
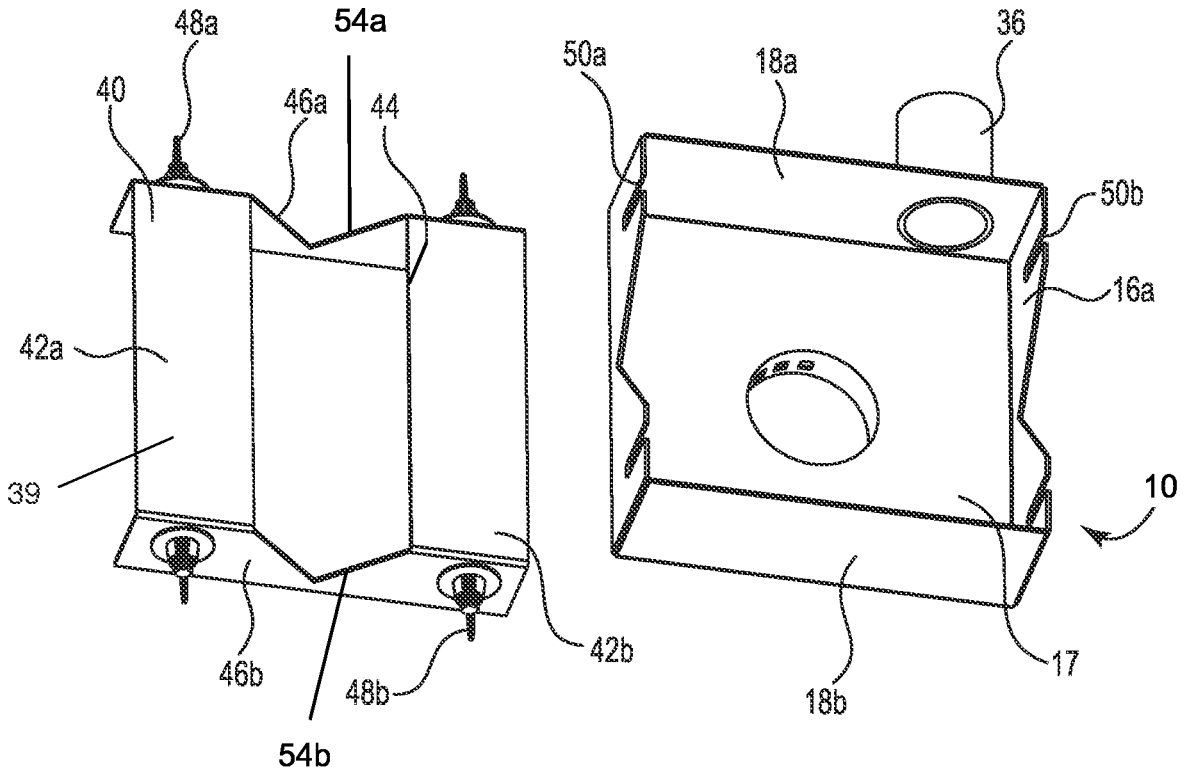
FIG. 4 is a bottom perspective view of the corner grinder shroud disassembled according to an example embodiment of the invention.
Figure 5:
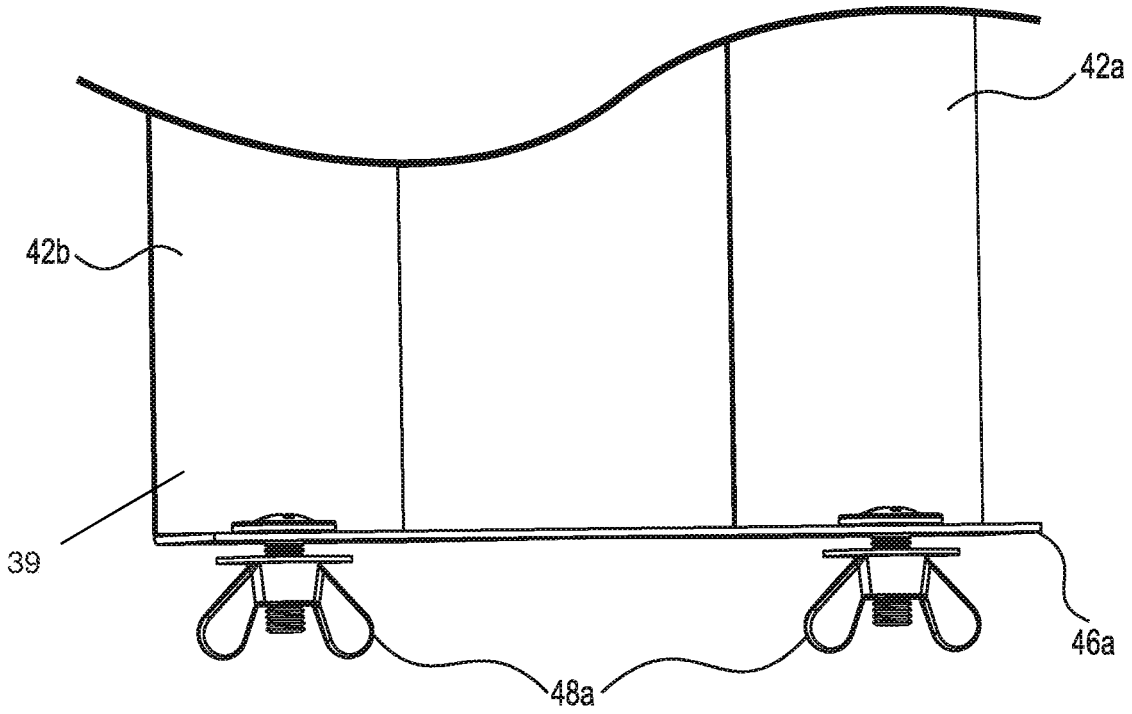
FIG. 5 is a bottom close up view of fasteners utilized to adjust a depth of the corner grinder shroud assembly according to an example embodiment of the invention.
Figure 6:
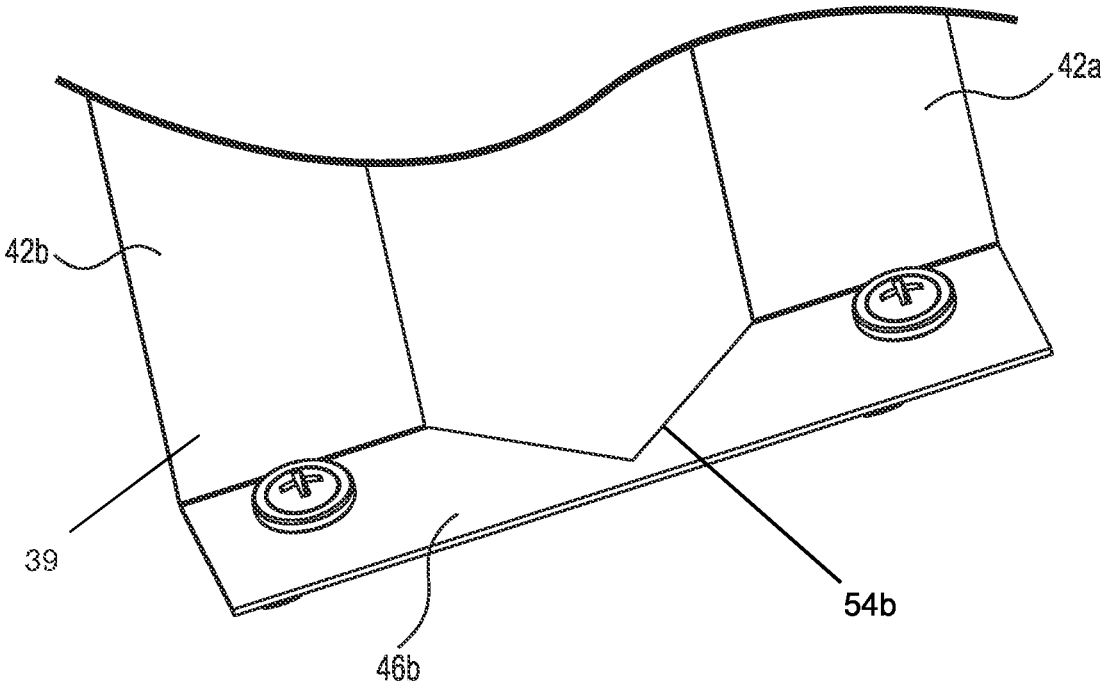
FIG. 6 is a bottom close-up view of fasteners utilized to adjust a depth of the corner grinder shroud assembly according to an example embodiment of the invention.

As illustrated in FIG. 4, the bottom wall 40 has a first end wall 46*a* and a second end wall 46*b* that can abut the end walls 16*a* and 16*b* of the bonnet 12. The end walls 46*a* and 46*b* of the angle guide 39 include one or more couplers, fasteners or guides 48*a*-48*b* that are removably positionable in matting slots 50*a*-50*b* extending in the end walls 16*a* and 16*b* of the bonnet 12. The fasteners or guides 48*a*-48*b* may comprise a post, screw and nuts, screw and wing nuts, or any other similar fastener capable of securing the angle guide 39 to the bonnet 12.

In use, the spindle 2, without the grinding disk 4 of the grinder 1 is insertable through the opening of the collar 30 of the bonnet 12. The latch 5 on the body of the grinder 1 is moved to engage with the holes 32, thereby securing the bonnet 12 to the grinder 1. The fasteners or couplers 48*a* and 48*b* are loosened to remove the angle guide 39. Once the angle guide 39 is removed the grinding disk 4 is attached to the end of the spindle 2. The angle guide 39 is positioned back within the interior 17 of the bonnet 12 by inserting the fasteners or couplers 48*a* and 48*b* within the slots 50*a* and 50*b* and tightening the fasteners or couplers 48*a* and 48. The size of the chamfer is set by moving the bottom wall 40 with respect to the upper surface 14 of the bonnet 12 in order to adjust a distance between the apex of the adjustable notches 54*a* and 54*b* and the grinding wheel 4. The bottom wall 40 may also be moved to adjust a height, depth, or space between the upper surface 14 of the bonnet 12 and the bottom wall 40 of the angle guide in order to accommodate spindles 2 of various lengths and/or grinding disks of various thickness.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. An dust shroud assembly for containing particles created by a grinder having a spindle and a grinding medium grinding an outside-corner, the dust shroud comprising:

an upper surface connectable to a portion of the grinder;

an opening extending through a portion of the upper surface for receiving the spindle of the grinder;

a perimeter wall attached to and extending downwardly from a portion of the upper surface, the upper surface and perimeter wall defining an interior of the shroud for containing the grinding medium and retaining the particles;

at least one pair of notches formed in a portion of the perimeter wall for receiving the outside-corner to be ground by the grinding medium, the at least two notches being generally opposed from each other; and a discharge port attached to and extending away from a portion of the perimeter wall, the discharge port being in fluid communication with the interior to direct a flow of the particles out of the interior;

wherein the grinding medium and the at least one pair of notches are configured to form a chamfer angle on the outside-corner.

2. The dust shroud assembly of claim 1 further comprising a bottom wall connected to and extending between a portion of the perimeter wall to at least partially enclose the interior of the shroud, the bottom wall having an opening extending through it, the opening in the bottom wall being aligned with the at least one pair of notches for enabling the shroud to fit over the outside-corner to be ground.

3. The dust shroud assembly of claim 2 further comprising at least one coupler connected to and extending between the perimeter wall and a portion of the bottom wall to enable adjustment of the bottom wall with respect to the perimeter wall.

4. The dust shroud assembly of claim 1, further comprising an angle guide for adjusting a size of an angle being ground in the outside-corner, the angle guide comprising;

a bottom wall having a corner opening, the bottom wall connected to and extending between a portion of the perimeter wall to at least partially enclose the interior of the shroud;

at least one pair of end walls connected to and extending upwardly from the bottom wall; and adjustable corner notches extending into a portion of the at least one pair of end walls for receiving the outside-corner to be ground, the adjustable corner notches being aligned to each other and the at least one pair of notches of the perimeter wall;

wherein movement of the angle guide with respect to the shroud adjusts a distance between the adjustable corner notches and the grinding medium, thereby adjusting a size of the angle being ground into the outside-corner.

5. The dust shroud assembly of claim 4, further comprising;

at least one slot formed in the perimeter wall and extending between the upper surface and the free end;

a guide connected to and extending away from a portion of at least one of the end walls, the guide being adjustably positionable in the at least one slot;

wherein the guide is movably adjustable along a length of the slot to enable adjustment of the size of the angle to be ground into the outside-corner.

6. The dust shroud assembly of claim 5, wherein the guide comprises fastener capable of adjustably securing the guide to a portion of the perimeter wall.

7. The dust shroud assembly of claim 4, wherein the adjustable corner notches form an angle of 90 degrees.

8. The dust shroud assembly of claim 1, wherein the at least one pair notches each form an angle of 90 degrees.

9. An adjustable dust shroud assembly capable of grinding chamfer angles of various sizes on outside-corners, the shroud assembly being adapted to be connectable to a grinder having a spindle and a grinding medium, the adjustable dust shroud assembly comprising:

a bonnet having an upper surface and a perimeter wall attached to and extending downwardly from a portion of the upper surface, the upper surface and perimeter wall defining an interior for containing the grinding medium, at least one pair of notches is formed in a portion of the perimeter wall for receiving the outside-corner to be ground by the grinding medium, the at least one pair of notches being aligned with each other; and an angle guide adjustably nested in the interior of the bonnet, the angle guide having a bottom wall with a corner opening and at least one pair of end walls attached to and extending upwardly therefrom; at least one adjustable corner notch extending into a portion of each of the at least one pair of end walls for receiving the outside-corner to be ground, the at least one adjustable corner notches being generally opposed to and aligned to each other and the at least one pair of notches of the perimeter wall;

wherein adjustment of the angle guide adjusts a distance between the at least one pair of notches and the grinding medium, thereby adjusting a size of a chamfer ground into the outside-corner.

10. The adjustable dust shroud assembly of claim 9 further comprising at least one connector coupled to and extending between a portion of the at least one pair of end walls and the perimeter wall to enable selective adjustment of the angle guide with respect to the bonnet.

11. The adjustable dust shroud assembly of claim 10 further comprising:

at least one slot formed in the perimeter wall and extending between the upper surface and the free end; and a guide connected to and extending away from a portion of at least one of the end walls, the guide being adjustably positionable in the at least one slot;

wherein the angle guide is movably adjustable along a length of the slot to enable adjustment of the size of the angle to be ground into the outside-corner.

12. The adjustable dust shroud assembly of claim 11, wherein the guide comprises an adjustable nut and bolt.

13. The adjustable dust shroud of claim 9 further comprising a discharge port attached to and extending away from a portion of the perimeter wall, the discharge port being in fluid communication with the interior to direct a flow of the particles out of the interior.

14. The adjustable dust shroud assembly of claim 13 further comprising a conduit attachable to the discharge port and connectable to a vacuum system.

15. The adjustable dust shroud assembly of claim 13, wherein the discharge port is positioned on the bonnet proximate to an area of particle generation.

16. The adjustable dust shroud assembly of claim 9 further comprising an opening extending through a portion of the bonnet, the opening having a size and shape configured to connect with a portion of the grinder.

17. The adjustable dust shroud assembly of claim 9 further comprising a collar attached to and extending upwardly from the upper surface of the bonnet, the collar having a size and shape adapted to connect with a portion of the grinder;

wherein the spindle of the grinder extends through the collar and the upper surface and is operatively coupled to the grinding medium positioned in the interior.

18. The adjustable dust shroud assembly of claim 9, wherein the at least one pair notches each form an angle of 90 degrees.

19. The adjustable dust shroud assembly of claim 9, wherein the at least one pair of notches and the adjustable corner notches permits grinding in at least two directions.

* * * * *